US005185229A

United States Patent [19]

Sato et al.

[11] Patent Number: 5,185,229

[45] Date of Patent: Feb. 9, 1993

[54] DRY TONER FOR HIGH SPEED ELECTROPHOTOGRAPHY

[75] Inventors: Haruhiko Sato, Kyoto; Katsuaki Kida; Akio Kashihara, both of Osaka, all of Japan

[73] Assignee: Nippon Paint Co., Limited, Osaka, Japan

[21] Appl. No.: 643,935

[22] Filed: Jan. 22, 1991

[30] Foreign Application Priority Data

Jan. 19, 1990 [JP] Japan ..... 2-10920

[51] Int. Cl.[5] ..... G03G 9/08

[52] U.S. Cl. ..... 430/110; 430/109; 430/137; 430/138

[58] Field of Search ..... 430/109, 110, 137, 138

[56] References Cited

U.S. PATENT DOCUMENTS 4,937,167 6/1990 Moffat et al. ..... 430/137

4,939,060 7/1990 Tomiyama et al. ..... 430/106.6

*Primary Examiner*—Marion E. McCamish

*Assistant Examiner*—S. Rosasco

*Attorney, Agent, or Firm*—Wenderoth, Lind & Ponack

[57] ABSTRACT

Dry toner for electrophotography in the form of colored particles, each particle being composed of a colored core portion having an average diameter of 5 to 20$\mu$ and comprising as main ingredients, a coloring material and heat-meltable resin having a flow initiation temperature of 120° C. to 160° C., and a covering shell portion of a vinyl resin mixture of a comparatively low molecular weight component and a high molecular weight component, each having the maximum value in the molecular weight distribution curve obtained by gel-permeation chromatography of $8\times10^3$ to $3\times10^4$ and $8\times10^4$ to $5\times10^5$, respectively, and present in a ratio of Mw/Mn=5.0 or more; the weight ratio of said vinyl resins to the total weight of said core and shell portions being 8 to 25% by weight. The present dry toner is particularly useful for use in a high speed electrography.

5 Claims, No Drawings

DRY TONER FOR HIGH SPEED ELECTROPHOTOGRAPHY

FIELD OF INVENTION

The present invention relates to a dry toner for use in the development of electrostatic latent images in an electrographic, electrostatic recording on electrostatic printing process and the like and especially high speed electrography.

BACKGROUND OF THE INVENTION

Recently, with the diversification of the objectives of electrography, various toners or developers have been studied and developed depending on the respective objectives. Indeed, the principal object of such toner is to form a precise image, but various factors as, for example, electro-charging properties, carrying properties, fixing characteristics, preservation properties and the like, should be possessed by the toner particles themselves.

In the fixing of toner images, various methods have been proposed and among the known methods, the most popular one is the heat roll-fixing method. However, in the conventional heat roll-fixing method, a part of the image-forming toner particles is transferred on the surface of heat-roll at the time of offset development, i.e. at the fixing stage, which is again moved to the subsequent copying paper, resulting in the contamination thereof. Therefore, anti-offset properties, that is the hard transfer of toner particles to the heating roll surface, is strongly desired. In order to prevent the undesired offset phenomenon at the heating-roll-fixing stage, the recent toner particles contain releasing agents such as polyolefins (e.g. polypropylene, polyethylene and the like), paraffin wax and the like.

Attempts have been made to increase the amount of such releasing agent for better anti-offset property, and however, there often arises new question of melt-adhesion of toner particles during the preparation thereof.

In another approach, crosslinked resin or a mixture of different resins each having different molecular weight distribution had been used as a binder resin. However, in such methods there were problems that a much higher temperature should be used for the fixing purpose. (see Japanese Patent Publication No.23354/76, Japanese Patent Publication (unexamined) 217357/88).

In another method, (Japanese Patent Publication (unexamined) 210368/86), binder resin and colorant are dispersed on the surface of the respective spherical particles by using Henshel mixer, Super mixer or the like and they are fixed there upon by applying a heating energy at a temperature which is lower than the softening point of said spherical particle and higher than the softening point of said binder resin. However, in this method, besides the problem of limited materials, there are problems that technically, it is very difficult to obviate the formation of fused mass of spherical particles at the heating stage (usually at 110°-140° C., for 10 minutes) and in some cases, there arises the thermal degradation of the employed materials. There are also such proposals that releasing microparticles are applied on the toner particles (see Japanese Patent Publication (unexamined) 244053/88 and charge controlling microparticles are applied on the toner particles (Japanese Patent Publication (unexamined) 244056/88).

The above procedures are, indeed, effective in giving a fairly good solution for each separate problem, but do not fully satisfy every aspect of the requirements for ideal toners. Furthermore, the heretofore proposed dry toners cannot be used in the latest high speed copying machines.

It is, therefore, an object of the invention to provide a dry toner for a high speed copying use, which is excellent in anti-offset properties, can be easily adjusted or controlled in electrification and has a comparatively low fixing temperature. An additional object of the invention is to provide a dry toner being specifically useful in a high speed copying, and having excellent powder-coating properties as electrification, developing amount, cleaning property, carrying property and the like which are desired for the image-improvement in respects of ultra-fine-live-reproduction, texture, dot reproduction, toning, resolving power and the like. Further object of the present invention is to provide a dry toner having spherical or quasi-spherical from and being excellent in application properties.

SUMMARY OF THE INVENTION

According to the present invention, the abovementioned objects can be attained with a dry toner for high speed electrophotography in the form of colored particles, each particle being composed of a colored core portion having an average diameter of 5 to 20 $\mu$ and comprising as a main ingredient, a heat-meltable resin having a flow initiation temperature of 120° to 160° C., and a covering shell portion of a vinyl resin mixture of a comparatively low molecular weight component and a high molecular weight component, each having a maximum value in the molecular weight distribution cure obtained by gel-permeation chromatography of $8\times10^3-3\times10^4$ and $8\times10^4-5\times10^5$, respectively, in a ratio of $Mw/Mn=5.0$ or more, the weight ratio of said vinyl resins to the total weight of said core and shell portions being 8 to 25% by weight.

PREFERRED EMBODIMENTS OF THE INVENTION

As abovementioned, the present dry toner comprises colored particles, each particle being composed of a colored core portion and an uncolored vinyl resin overcoat portion, and said core portion comprising as main ingredients, a coloring material and a heat-meltable resin having a specified flow initiation temperature.

The term "flow initiation temperature of resin" as used in the claims and specification shall denote the temperature (Tfb)° C. at which the resin starts flowing out from the orifice (1 mm 0.5 mm diametu) of Flow Tester CFT-500c, manufactured by Shimazu Seisakusho, under 20kg/cm$^2$ load. The core forming resin may be any kind of resin customarily used for the preparation of toner particles, as, for example, vinyl resins, polyester resins, epoxy resins, styrene-maleic acid resins and the like. The flow initiation temperature of the selected resin should be in a range of 120° to 160°, in this invention. If the flow initiation temperature of core-forming resin is less than 120° C., at the time when the colored core particles are prepared by the solution polymerization of monomers, pulverization of the thus formed polymer and shieving, considerable difficulties are encountered during the operations and more over, undesired blocking of the formed particles often occurs.

If the flow initiation temperature is more than 160° C., the formed resin particles are liable to be easily crushed to fine particles and cannot be used in a high speed copying machine, because of their excessively hard nature.

The core resin particles include coloring materials, which may be organic or inorganic pigments or dyestuffs and have an average particle diametur of 5 to 20 μ.

As the coloring material, various kinds and various color pigments or dyestuffs may be appropriately selected and used depending on the objectives. Typical examples of coloring materials are as follows: (1) black pigments such as carbon black, copper oxide, manganese dioxide, aniline black, active carbon and the like; (2) yellow pigments such as chrome yellow, zinc chrome, cadmium yellow, yellow iron oxide, mineral fast yellow, nickel-titanium yellow, navel yellow, naphthol yellow-S, Van zahi yellow-G, Van zahi yellow -10G, benzidine yellow-G, benzidine yellow-GR,quinoline yellow lake, permanent yellow-NCG, tartrazine lake and the like; (3) orange pigment such as red chrome yellow, molybdenum orange, permanent orange GTR, pyrazolone orange, vulcan orange, indanthrene brilliant orange RK, benzidine orange G, indanthrene brilliant orange GK and the like; (4) red pigments such as iron oxide red, cadmium red, minium, mercury sulfide, cadmium permanent red 4R, lithol red, pyrazolone red, watching red, calcium salt, lake red D, brilliant carmine 6B, eosine lake, rhodamine lake B, alizarine lake, brilliant carmine 3B and the like; (5) blue pigments such as ultramarine blue, cobalt blue, alkali blue lake, victoria blue lake, phthalocyanine blue, non-metal phthalocyanine blue, partially chlorinated phthalocyanine blue, fast sky blue, indanthrene blue-BC and the like; (6) basic, acidic, dispersion or direct dyestuffs, such as nigrosine, methylene blue, quinoline yellow, ultramarine blue and the like.

These coloring materials may be used each in singularly or in combinations of two or more. However, the content of such coloring material in the toner particle should preferably be in a range of 1 to 20% by weight, most preferably 2 to 10% by weight, of the total resin content.

The above proportions are important because if the coloring material content is more than 20% by weight, the fixing property of the toner tends to be adversely affected and when it is less than 1% by weight, the desired image density may not be obtained.

The colored core portion of the present toner is the particle comprising the abovementioned heat-meltable resin and coloring material and having an average diameter of 5 to 20 μ.

The core particle may further contain wax for anti-offset purposes, as desired. Examples of such wax are polyolefin wax (e.g. polyethylene wax, polypropylene wax and the like), paraffin wax, and their grafted products with polymerizable, such as styrene, alkyl acrylate, alkyl methacrylate and the like.

Since the desired improvement in anti-offset effects cannot be obtained with a small amount of wax, the wax content should preferably be in the range of 10 to 20 wt% of the colored core particle.

If desired, other binder resins being compatible with the abovementioned heat-meltable resin, pigment dispersion resin, and other toner additives, may be added to the core particle. The present core particles may be advantageously prepared by kneading a mixture of the abovementioned core-forming resins, coloring materials, and other optional wax, resins and additives in a known mixing machine, such as a heat roll, Banbury mixer, extruder and the like, pulverizing the formed mass and shieving the powder thus-obtained.

However, for high speed copying purposes, the toner particles should preferably be in spherical form from the standpoint of operational easiness, uniform heat-adhesion and the like, and hence, the present core particles should also preferably be spherical or substantically spherical for the same reasons and also for the uniform coating of the shell portion. Such spherical core particles may most adventageously be prepared by effecting polymerization or copolymerization of one or more polymerizable monomers for the core-forming vinyl resin, as for example, styrene, methyl styrene and other styrene derivatives; acrylates and methacrylates (e.g. methyl methacrylate, ethyl methacrylate, butyl methacrylate, ethyl acrylate, butyl acrylate and the like); acrylonitrite, methacrylonitrile; acryl amide, methacryl amide, and other acrylic or methacrylic derivatives, in the presence of a polymerization initiations and especially oil soluble initiator as, for example, 2,2'-azobis-2,4-dimethyl valeronitrile, 2,2'-azobis-4-methoxy-2,4-dimethyl valeronitrile and other azo compounds, acetyl cyclo-hexyl sulfonyl peroxide, diisopropyl peroxy dicarbonate, decanonyl peroxide, lauroyl peroxide, stearoyl peroxide, acetyl peroxide, t-butyl peroxy-2-ethyl hexanoate, benzoyl peroxide, t-butyl peroxy isobutyrate, cyclohexanone peroxide, methyl ethyl ketone peroxide, dicumyl peroxide, t-butyl hydroperoxide, di-t-butyl peroxide, cumene hydro-peroxide and other peroxides, and in the presence of coloring material and optional wax and other additives. Therefore, in a particularly preferable enbodiment of this invention, the colored core particles are prepared by using a suspension polymerization method wherein a polymerization mixture consisting of polymerizable monomers, polymerization initiators, coloring materials and optional wax and other additives are suspended, together with such dispersion-stabilizing resin as polyvinyl alcohol, methyl cellulose, ethyl cellulose and the like, in an aqueous medium and polymerization is effected in such medium; or by using a dispersion polymerization method (described in Japanese Patent Publications (unexamined) 328068/86 and 100466/88) wherein the above-mentioned polymerization mixture is dispersed, together with such dispersion-stabilizing resin as polyvinylpyrolidone, polyacrylic acid, hydroxy propyl cellulose, partially saponified poly vinyl acetate and the like, in an alcohlic and/or ether-alcoholic medium and polymerization is carried out in such medium. In the abovementioned polymerization, the polymerization initiator is usually employed in an amount of 0.01 to 10% by weight of the monomer weight.

As already stated, the core-forming resin should have a specific range of flow initiation temperatures and this requirement may be satisfied by using an epoxy or polyester resin having a number average molecular weight of 600–400 (a weight of 2000–10000) or vinyl resin having a number average molecular weight of 3000–25000.

The present toner is characterized in that an uncolored resinous shell composed of particular vinyl resins is placed on the outer surface of the abovementioned colored core particles in a specific weight ratio.

That is, the shell-forming resin is a mixture of a comparatively low molecular weight vinyl resin having a maximum value in a molecular weight distribution curve obtained by gel-permeation chromatography in a range of $8\times10^3-3\times10$and a comparatively high molecular weight vinyl resin having a maximum value in a range of $8\times10^4-5\times$ $^5$, in the ratio of Mw/Mn =5.0 or more.

And, in the present toner, such vinyl resins are included in a weight ratio of 8–25% of the total weight of the core particles and the outer shell portion.

Since the present toner is intended to use in a high speed copying machine, the softening point (flow initiation temperature) of the resin should be low. In the case of a vinyl resin, this softening point, in general, depends on the molecular weight of the resin. The inventors have found that to achieve better fixing properties for a toner to be used in a high speed copying, a comparatively low molecular weight vinyl resin having the maximum value in a range of $8\times10^3-3\times10^4$ must be present at least in the outer shell. If the abovementioned maximum value of vinyl resin is less than $8\times10^3$, the thus formed toner particles show undesirable blocking and if the maximum value exceeds $3\times10^4$, it is hardly possible to attain the desired fixing properties for the formed toner in a high speed copying machine.

Additionally, in an electrophotographic method, the copy image should have a sufficient rubbing resistance so that the image toner does not fall off at the time of rubbing by hands by an eraser. The inventors have found that in the case of vinyl resin, the higher the molecular weight, the stronger the rubbing resistance and that for the desired rubbing resistance, the maximum value of the vinyl resin in a molecular weight distribution curve obtained by a gel-permeation chromatography should be in the range of $8\times10^4-5\times10^4-5\times10^5$. If the abovementioned maximum value is more than $5\times10^5$, such vinyl resin cannot be used because the fixing properties would be adversely affected, and if the maximum value is less than $8\times10^4$, the desired rubbing resistance cannot be obtained. Thus, in the vinyl resin composition used in the resinous shell portion, it is essential that a comparatively high molecular weight vinyl resin component having a maximum value in a range of $8\times10^4-5\times10^5$ be included. The inventors have further found that when the outer shell portion is composed of a vinyl resin mixture of the abovementioned low molecular weight component and high molecular weight component in a ratio of Mw/Mn =5.0 or more i,e. weight ratio of 30/70–70/30, both requirements of better fixing at a high speed copying and improved rubbing resistance can be fulfilled.

Such resinous composition should be present on the outer surface of the core particle as a uniform coating. However, such outer shell must be of a uniform continuous phase and should not be so thick as to cause a decrease in the image density and an increase in fixing temperature. Having studied the weight ratio of the uncolored vinyl resin coating and the colored core particle and the preparation of the resinous shell on the colored core portion, the inventors have found that the coating weight of the resinous shell should preferably be in the range of 8 to 25% by weight of the total weight of the colored core portion and outer shell portion and that the outer shell be most advantageously prepared by uniformly adhering the shell-forming vinyl resin microparticles onto the colored core particles and melting the vinyl resin microparticles alone by a local heating means to form a uniform coating.

If the weight ratio of the shell portion is less than 8% by weight, one cannot attain a complete coating, in that a coat having poor charging stability, blocking resistance, offset resistance and fixing properties is produced. If such weight ratio exceeds the upper limit of 25% by weight, there arises a problem of lowered image density and increased fixing temperatures due to a decrease in the colored core particle ratio. In the preparation of the present toner by adhering the vinyl resin microparticles onto the colored core particles and softening the said microparticles, the vinyl resin microparticles should preferably have an average diameter of 0.3 $\mu$ or less.

If the average diameter of said microparticles exceeds 0.3 $\mu$, it is difficult to form a uniform continuous layer of outer shell on the surface of the colored core particles, resulting in poor charging stability, blocking resistance, offset resistance stability and the like. Such vinyl resin microparticles having an average diameter of 0.3 $\mu$ or less may be advantageously prepared by the known emulsion polymerization techniques, that is, by the polymerization of vinyl monomer in an aqueous medium in the presence or absence of a surfactant, using a water soluble or oil soluble polymerization initiator.

As a surfactant, any of the known anionic surfactants, such as sodium alkyl benzene sulfonate, sodium alkyl sulfate and the like, and nonionic surfactants, such as polyethylene glycol alkyl phenyl ethers, polyethylene glycol sorbitan esters and the like may be satisfactorily used each singularly or in a combination of 2 or more. Of course, surfactants other than the abovementioned surfactants may be used as desired.

As the polymerization initiator, one may use potassium persulfate, ammonium persulfate, azobis-cyanovaleric acid, 2,2'-azo-bis (2-methyl propionamidine)-dihydroxy chloride, 2,2'-azo bis[2-(2-imidazolin-2-yl)propane]-dihydrochloride and various azo- and peroxide-series initiators already mentioned previously in connection with the core particles may be satisfactorily used.

As the vinyl monomers, styrene and its derivatives, acrylates, methacrylates, acrylic acid, methacrylic acid, other acrylic or methacrylic acid derivatives, and various other $\alpha$, $\beta$-ethylenically unsaturated compounds customarily used in the preparation of vinyl resin may be satisfactorily used. The vinyl resin microparticles having an average diameter of 0.3 $\mu$ or less may also be advantageously prepared by the known NAD method (non-aqueous dispersion polymerization method).

At that time, in a reaction medium which is a solvent for monomers but cannot dissolve the produced polymer as aliphatic hydrocarbon (e.g. hexane, heptane and the like), the polymerizable monomers are polymerized in the presence of such polymerization dispersion stabilizer as comb-shaped polymers obtained by the polymerization of oligomers having radically polymerizable double bonds derived from the reaction of resins having comparatively polar segments and being soluble in the reaction medium as, for example, condensation products of 3 to 5 molecules of 12-hydroxy stearic acid and glycidyl methacrylate, and comparatively polar monomers, for example, such as acrylates, methacrylate, acrylic acid, methacrylic acid, hydroxy alkyl acrylate or hydroxy alkyl methacrylate and the like.

The vinyl resins, each having different molecular weight, and having maximum valves in the molecular weight distribution curve, determined by gel-permeation chromatography, in the range of $8\times10^3$ $3\times10^4$ and $8\times10^4-5\times10^5$, may be obtained by preparing the vinyl resins with the defined molecular weights each separately by controlling the polymerization conditions and mixing thus obtained resins in the defined weight ratio or by effecting the polymerization in 2 stages so that in each stage, the different vinyl resins can be prepared. When polymerizing vinyl monomers with a chain transfer agent as an alkyl mercaptan (e.g. lauryl mercaptan, t-dodecyl mercaptan and butyl mercaptan and the like) or alkyl thioglycolate (e.g. octyl thioglycolate) is used, a vinyl resin having a comparatively low molecular weight can be obtained. Therefore, the abovementioned polymerization may be carried out in two different stages, one under the conditions of introducing a monomer mixture and a chain transfer agent and the other by the introduction of the monomer mixture alone.

Alternatively, in either one of said two stages, a so-called poly-functional peroxide polymerization initiator, such as 1,3-bis (t-butyl peroxy-isopropyl) benzene, 1,1-di-t-butyl peroxy cyclohexane, 2,2-di-(t-butyl peroxy) butane, di-t-butyl peroxy hexahydro-terephthalate, 2,2-bis (4,4-di-t-butyl peroxy cyclohexyl) propane and the like may be used.

Furthermore, the abovementioned polymerization may be carried out in two different stages, in one stage, the abovementioned poly functional peroxide is used and in the other stage, and other polymerization initiator is used instead to obtain the desired vinyl resin composition.

As already stated, the continuous layer of the shell portion of the present toner may be advantageously prepared by mixing the colored core particles and the resin microparticles for the shell portions in an appropriate compounding ratio, i.e. in amounts of 8 to 25% by weight of the total weight of the toner, thereby uniformly adhering the shell microparticles on the core particles by van der Waals force or an electrostatic force, fixing the microparticles and forming the film therewith, by, for example, applying impact strength and generating thermal energy to soften the resin microparticles. At that time, a hybridization system utilizing the impact strength in a high speed gaseous current (Nara Machinery Manufacturing Co.), Ångmil (Hosokawa Micron), Mechano-mil (Osaka Seiko) and the like may be advantageously used.

Although it is not always necessary in this invention, it is preferable to include a charge controlling agent in the continuous layer of outer shell to control the changes therein. As the charge controlling agent, any of the organic or inorganic materials may be satisfactorily used which provide positive or negative changes by frictional charging thereof.

Examples of positive charge controlling agents are nigrosine base EX (manufactured by Orient Chem. Ind. Ltd.), quaternary ammonium salt P-51 (manufactured by Orient Chem. Ind. Ltd.), nigrosine Bontron N-01 (manufactured by Orient Chem. Ind. Ltd.), Sudan chief Schwartz BB (Solvent black 3:Color Index 26150), Föt Schwartz HBN (C,1. No. 26150), brilliant Spirit Schwartz TN (Bayer), Zabon Shwartz X (Höchst), alkoxylated amines, alkyl amides, molybdic acid chelate pigment and the like.

Examples of negative charge controlling agents are oil black (Color Index 26150), oil black BY (Orient Chem. Ind. Ltd.), Bontrone S-22 (Orient Chem. Ind. Ltd.), salicylic acid metal complex E-81 (Orient Chem. Ind. Ltd.), thioindigo pigment, sulfonyl amine derivative of copper phthalocyanine, spiron black TRH (Hodogaya Chem. Ind. Ltd.), Bontrone S-34 (Orient Chem. Ind. Ltd.), nigrosine SO (Orient Chem. Ind. Ltd.), Seleschwartz (R) G (Bayer), chromogen schwartz ET00 (C,1. No. 14645), azo oil black (R) (National Aniline) and the like. These charge controlling agents may be used singularly or in a combination of two or more in an amount of up to 5% by weight. When used, the charge environmental stability is greatly improved. That is, there is no substantial difference in image quality between the image obtained under high temperature-high humidity conditions and an image obtained under low temperature-low humidity conditions, and stable images can be obtained under any environmental conditions. However, if the content of charge controlling agent exceeds 5 wt%, there is the fear that at certain amount of charge controlling agent will be released from the continuous outer shell and enter into the developer, thereby resulting in inferior copies.

However, in the present invention, the desired charge control may be obtained by the continuous outer shell layer itself, even without using the abovementioned charge controlling agent. When a charge controlling agent is used, it may be advantageously fixed on the outer shell portion by mixing it with the shell-forming vinyl resin microparticles or adhering the charge controlling agent to the shell surface and applying mechanical impact strength thereupon.

The invention shall now be more fully explained in the following Examples. Unless otherwise being stated, all parts and percentages are by weight.

EXAMPLE 1

| | |
|---|---|
| Polyester resin (OH value 30, number average molecular weight 2,700, melting point 91° C.) | 79 parts |
| triglycidyl isocyanate | 1 part |
| carbon black | 8 parts |
| polypropylene wax (Viscol 660 P, manufactured by Sanyo Kasei Kogyo) | 12 parts |

The abovementioned components were pre-mixed in a Henshel mixer, and then melted, mixed and extruded by a biaxial extruder.

After cooling, the cooled mass was crushed, pulverized and shieved to obtain a black colored mother particle toner. Separately, into a 5 liters flask fitted with a stirrer, a thermometer, a thermostat and a nitrogen gas inlet tube, was placed 3,100 parts of deionized water and 24 parts of cationic surfactant (Cation 300, manufactured by Sanyo Kasei Kogyo) and the mixture was heated to 70° C. To this, a solution of 4 parts of 4 parts of 2,2'-azobis (2-methyl propionamidine) dihydrochloride in 100 parts of deionized water was added and after 5 minutes, a mixture of 270 parts of methyl methacrylate, 90 parts of n-butyl acrylate and 5.5 parts of laurylmercaptane was added dropwise over 40 minutes. After completion of said addition, the mixture was allowed to stand for 20 minutes and then a mixture of 340 parts of methyl methacrylate and 100 parts of n-butyl acrylate was added dropwise over 60 minutes. After completion of said addition, the mixture was left standing at the same temperature for 90 minutes. The thus-obtained emulsion particles had an average diameter of 60 nm. By GPC analysis (styrene conversion), the Number average molecular weight was determined to be 1,100 and the weight average molecular weight 93,000, $Mw/Mn = 8.5$. Two peaks were observed at $5.2 \times 10^4$ and $1.8 \times 10^5$.

This emulsion was subjected to spray drying to obtain the resin particles.

90 parts of the abovementioned mother particle toner and 10 parts of the dried emulsion were placed in Hybridizer (manufactured by Nara Kikai) and treated in the machine for 10 minutes to obtain the present dry toner (hereinafter referred to as an capsulated toner).

To 100 parts of thus obtained capsulated toner, 0.5 part of aluminium oxide was added and mixed well to obtain a black colored toner with + polarity.

3 parts of thus obtained toner and 97 parts of a epoxy coated ferrite carrier were mixed well, and used in a digital type printer (A4 papers 60 pages/min.) (heat toll temperature 190° C). Clear images containing no offset and fogging were obtained. Rubbing tests (3 reciprocal rubbings with eraser) were carried out, but the retention of reflective density was 0.95, indicating a complete fixing of the images.

This toner was stored at 50° C. for 24 hours but there was no blocking of the stored toner.

EXAMPLE 2

| | |
|---|---|
| Styrene-acrylic resin (Hymer SBM-73F, Sanyo Kasei) | 40 parts |
| Styrene monomer | 42 parts |
| n-butyl acrylate | 17.5 parts |
| ethyleneglycol dimethacrylate | 0.5 part |
| azobisisobutyronitrile | 3 parts |
| carbon black | 8 parts |
| polypropylene grafted resin obtained in Example 1 of Japanese Patent Publication (unexamined) 201676/89 | 18 parts |

The abovementioned components were treated in a sand grinder mill to obtain a dispersion in which carbon black and a polypropylene grafted resin were uniformly dispersed and said dispersion was then suspended in distilled water containing 0.6 part of fully saponified polyvinyl alcohol and the gaseous phase was replaced with nitrogen. Then the mixture was heated to 80° C. and maintained at the same temperature for 4 hours to complete the polymerization. After cooling, the reaction mixture was dehydrated, washed and again dehydrated several times, to obtain a dried product.

This was then shieved to obtain black colored mother toner particles having an average diameter of 5 to 15 μm. Into a similar reaction vessel as used in Example 1, was placed 3,100 parts of deionized water and 4 parts of sodium dodecylbenzene sulfonate, and the combined mixture was heated to 80° C. To this, a solution of 8 parts of potassium persulfate in 100 parts of deionized water was added and after 10 minutes, a mixture of 280 parts of methyl methacrylate, 40 parts of styrene, 80 parts of 2-ethylhexyl acrylate and 7 parts of t-dodecyl mercaptan was added dropwise over 50 minutes. After completion of said addition, the combined mixture was allowed to stand for 30 minutes. Thereafter, a mixture of 300 parts of methyl methacrylate, 40 parts of styrene, and 60 parts of 2-ethylhexyl acrylate was added dropwise over 50 minutes and after completion of said addition, the combined mixture was maintained at the same temperature for 90 minutes. The thus-obtained emulsion had an average diameter of 120nm, the GPC showed a number average molecular weight=9500, a weight average molecular weight=88000, a Mw/Mn=9.51 and 2 peaks at $3\times10^4$ and $2.2\times10^5$.

The emulsion was then subjected to spray drying to obtain uncolored resin microparticles (hereinafter referred to as a dried emulsion).

87 parts of the abovementioned black colored mother particles and 13 parts of the dried emulsion were treated in hybridizer for 10 minutes to obtain a capsulated toner.

100 parts of thus obtained capsulated toner and 2 parts of hydrophobic silica (R-972, manufactured by Nippon Aerosil) were mixed well to obtain a black colored toner with(-)polarity. 3 parts of the abovementioned toner were mixed well with 97 parts of acryl-coated ferrite carrier and thus obtained mixture was used in a copier (A-4 size papers 57 pages/minute, heat-roll temperature 190° C.).

The thus-obtained image was very clear and showed no offset and fogging. When subjected to a rubbing test (3 reciprocal rubbing with an eraser), the retention of reflective density was found to be 0.97, indicating complete fixing of the copy image. The abovementioned toner was stored at 50° C. for 24 hours, but no blocking was observed.

COMPARATIVE EXAMPLE 1

A similar dried emulsion was prepared as in Example 1 except for omitting lauryl mercaptan. The resulted emulsion showed, by GPC analysis (styrene conversion), a number average molecular weight=68000, a weight average molecular weight =12500, Mw/Mn=1.8, and only one peak at $8\times10^4$.

Using the said dried emulsion, the comparative toner was prepared and tested as in Example 1. The rubbing test showed the retention of a reflective density of 0.76. Thus, the fixing property was no good.

COMPARATIVE EXAMPLE 2

A similar capsulated toner as stated in Example 1 was prepared, except for changing the weight ratio of the black colored mother particles to a dried emulsion having a ratio of from 90:10 to 96:4. The thus-obtained toner was used in the same copier as in Example 1, but the resulting copy showed fogging at blank, indicating the presence of charged toner.

COMPARATIVE EXAMPLE 3

The similar developer as shown in Example 1 was prepared, except for changing the amount of polypropylene wax from 12 parts to 6 parts, and used in copying only offset copies were obtained.

COMPARATIVE EXAMPLE 4

Uncolored resinous microparticles were prepared as in Example 2, but sodium dodecyl benzene sulfonate was not used in this Example. The thus-obtained dried emulsion had an average diameter of 0.4 μm. Using this dried emulsion, a similar developer as used in Example 2 was prepared and tested.

The thus-obtained image was not clear and considerably fogging was observed.

EXAMPLE 3

80 parts of black colored mother particles prepared by the suspension polymerization of Example 2 and subjected to shieving to the particle size of 5-15 μm, 10 parts of the dried emulsion obtained in Example 1 and 2 parts of nigrosine dyestuff (as charge controlling agent) were treated in hybridizer for 10 minutes. To this, 10 parts of the dried emulsion obtained in Example 1 were added and the combined mixture was treated in the same way for an additional 10 minutes to obtain capsulated toner. To 100 parts of the thus-obtained capsulated toner, 0.5 part of aluminium oxide was mixed well to obtain black colored toner with plus polarity.

3 parts of thus prepared toner were mixed with 97 parts of an epoxy-coated ferrite carrier and the combined mixture was used in a copier as in Example 1. The thus-obtained print showed excellent image and no offset and fogging characteristics.

When the similar rubbing test as described in Example 1 was carried out with the thus-obtained prints, the results showed a retention of reflective density of 0.96, indicating a complete fixing. Even when the abovementioned printing was carried out under high-temperature and high humidity conditions (28° C., 75%RH), a similar clear image was obtained. This toner was stored at 50° C. for 24 hours, but no blocking was observed.

What is claimed is:

1. A dry toner for electrophotography in the formed of colored particles, each particle being composed of a colored core portion having an average diameter of 5 to 20 μm and comprising as main ingredients, a coloring material and heat-meltable resin having a flow initiation temperature of 120° C. to 160° C., and a covering shell portion of a vinyl resin mixture of a comparatively low molecular weight component and a high molecular weight component, each having a maximum value in the molecular weight distribution curve obtained by gel-permeation chromatography of $8\times10^3$ to $3\times10^4$ and $8\times10^4$ to $5\times10^5$, respectively, in the ratio of Mw/Mn=5.0 or more; the weight ratio of said vinyl resins to the total weight of said core and shell portions being 8 to 25% by weight, and wherein the shell portion is a continuous covering layer on the core portion, prepared by adhering on said core resin, microparticles having an average diameter of 0.001 to 0.3 μm and composed of the abovementioned vinyl resin mixture, softening the microparticles by thermal energy and forming the film.

2. A dry toner according to claim 1, wherein the said colored core portion further contains wax in an amount of 10 to 20% by weight of the total core weight.

3. A dry toner according to claim 1, wherein the heat-meltable resin is selected from the group consisting of vinyl resin, polyester resin, epoxy resin and styrene-maleic acid resin.

4. A dry toner according to claim 1, wherein the colored core portion is a substantially spherical particle obtained by a suspension polymerization or disperison polymerization of a polymerization composition comprising polymerizable monomers capable of producing the heat-meltable resin, a coloring material and other optional additives.

5. A dry toner according to claim 1, wherein the shell portion further contains up to 5% by weight of a charge controlling agent.

* * * * *